US005497428A

United States Patent [19]

Rojas

[11] Patent Number: 5,497,428

[45] Date of Patent: Mar. 5, 1996

[54] SELF-COOLED MAGNETIC STRUCTURE FOR LOUDSPEAKERS

[76] Inventor: Omar E. Rojas, 2527, 481 St., (1896) City Bell, Buenos Aires, Argentina

[21] Appl. No.: 332,891

[22] Filed: Nov. 1, 1994

[51] Int. Cl.[6] ..... H04R 25/00

[52] U.S. Cl. ..... 381/199; 381/192; 381/194

[58] Field of Search ..... 381/192, 194, 381/195, 199, 193, 200, 201, 197, 165, 159; 181/152, 156, 199

[56] References Cited

U.S. PATENT DOCUMENTS

| | | | |
|---|---|---|---|
| 4,757,547 | 7/1988 | Danley | 381/194 |
| 5,042,072 | 8/1991 | Button . | |
| 5,357,586 | 10/1994 | Nordschow et al. | 381/192 |

FOREIGN PATENT DOCUMENTS

| | | | |
|---|---|---|---|
| 9209180 | 5/1992 | WIPO | 381/199 |

*Primary Examiner*—Curtis Kuntz
*Assistant Examiner*—Huyen D. Le
*Attorney, Agent, or Firm*—Vaden, Eickenroht, Thompson & Feather

[57] ABSTRACT

A self-cooled electrodynamic loudspeaker including a magnetic structure comprising a pole piece and a magnet arranged around the pole piece, a coil being capable of moving reciprocatingly between the piece and a magnet under the effect of a magnetic flux created across a magnetic gap formed between the pole piece and the magnet, the pole piece including at least two channels adjacent to the voice coil for the passage of cooling air, each channel continuously extending from an upper face of the piece, partially along a periphery of the piece and into a central cavity of the piece, the cavity being closed at the upper face of the piece and open into a lower face of the piece.

15 Claims, 4 Drawing Sheets

SELF-COOLED MAGNETIC STRUCTURE FOR LOUDSPEAKERS

BACKROUND OF THE INVENTION

1. Field of the Invention

The present invention relates to electrodynamic loudspeakers and particularly to the cooling of loudspeakers having a permanent magnet and a voice coil to make a diaphragm vibrate. Heat is produced in the coil or winding, particularly in high power loudspeakers, in which heat is carried by cooling air driven by the same loudspeaker structure, without the need of external blowers and other means.

2. Description of the Prior Art

Conventional electrodynamic loudspeakers generally comprise a diaphragm connected to a frame in a such a way manner that it can be made to vibrate by a coil capable of moving with reciprocating motion in a magnetic field of a permanent magnet. The interaction between this magnetic field generated by the magnet and a current or electrical signal passing through the voice coil causes this coil to oscillate along a longitudinal axis of the loudspeaker and drive the diaphragm to transduce the electrical signal into sound.

The alternating current passing through the coil and the resistance of the coil material generates heat the amount of which depends on the power involved. When the temperature is very high the loudspeaker structure can be affected, particularly if the temperature is higher than the melting points of the materials involved in the loudspeaker construction. Other parts, such as the adhesive of the windings or voice coil, can be destroyed. As it is well known, the power converted into heat is power that is lost, that is, this power is not turned into sound.

Another problem associated to heat generation is the power compression. As the temperature increases, the DC resistance of the conductors or wires, made of copper or aluminium, also increases, therefore, at higher temperatures, power input is converted mostly into additonal heat rather than sound.

Many attempts have been made to cool the voice coil during operation in order to maximize loudspeaker efficiency, by circulating cooling air through the coil by means of external blowers or by using the movement of the diaphragm to force air through the coil. The use of electrical blowers requires the provision of additional energy to drive them and, in addition, the operation of the blower as well as the uncontrollable positive generated pressure result in speaker distortion and noise.

U.S. Pat. No. 5,042,072 issued to Harman International Industries, Inc. discloses a self-cooled electrodynamic loudspeaker including a magnetic structure coprising a pole piece, a permanent magnet and a magnetic gap for receiving a voice coil, the pole piece having a plurality of passages extending from the magnetic gap completely to the other side of the magnetic structure, entirely along the periphery of the pole piece, that is from one end to the opposite end of the piece. The air is forced by the diaphragm through the several passages so as to remove heat from the wall of the piece just in the passages. It is obvious that the surface from which the heat can be removed is restricted to the inner walls of the channel or passage and this surface is not enough to remove all the necessary heat. In addition, the passages of U.S. Patent No. extend in the periphery and along the entire length of the pole piece so that the cylindrical wall of the piece is completely interrupted by each passage. Particularly the lower end of the piece, adjacent to a back plate capable of carrying magnetic flux from the magnet to the piece, is not continuous but formed by separated sectors, which results in a non-continuous and uniform distribution of the magnetic flux in the pole piece.

3. Summary of the Invention

To minimize and even completely solve the above drawbacks, the present invention provides a self-cooling pole piece for loudspeakers, this piece increases the efficiency in the heat removal by providing a more extended thermal exchanging surface without reducing the mechanical strengh of the piece.

It is another object of the invention to provide a self-cooling pole piece for loudspeakers, the pole piece provides a more uniform and continuous distribution of the magnetic flux through the piece, minimizing the surface interruptions, particularly in those areas of the piece where the magnetic flux is transferred from the permanent magnet to the pole piece.

It is a further object of the invention to provide a self-cooling pole piece for loudspeakers, of the kind comprising a piece constructed from a material capable of carrying magnetic flux, the piece forming part of a magnetic structure of the loudspeaker, the magnetic structure comprising a magnet and the pole piece, the pole piece defining a periphery adjacent to a voice coil, wherein the periphery of the pole piece includes at least two channels for circulation of cooling air, the channels continuously extending from an upper face of the piece, radially-inwardly and downwardly into a central cavity of the piece, the cavity being closed by a conical wall at an upper end of the piece and open into a lower end of the piece.

It is another object of the invention to provide a self-cooled electrodynamic loudspeaker comprising a frame, a reciprocating diaphragm connected to a voice coil, and a magnetic structure comprising a pole piece and a top plate adjacent to a magnet arranged around said pole piece, the coil being capable of moving reciprocatingly between said piece and the top plate magnet under the effect of a magnetic flux created across a magnetic gap formed between the pole piece and the top plate and magnet, wherein the improvement consists of at least two channels adjacent to the voice coil for the passage of air driven by movement of the diaphragm in response to current passing to the voice coil, each channel continuously extending from an upper face of the piece, partially along the periphery of the piece and into a central cavity of the piece, the cavity being closed at the upper face of the piece and open into a lower face of the piece.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Referring now in detail to the drawings.

Figure 1:
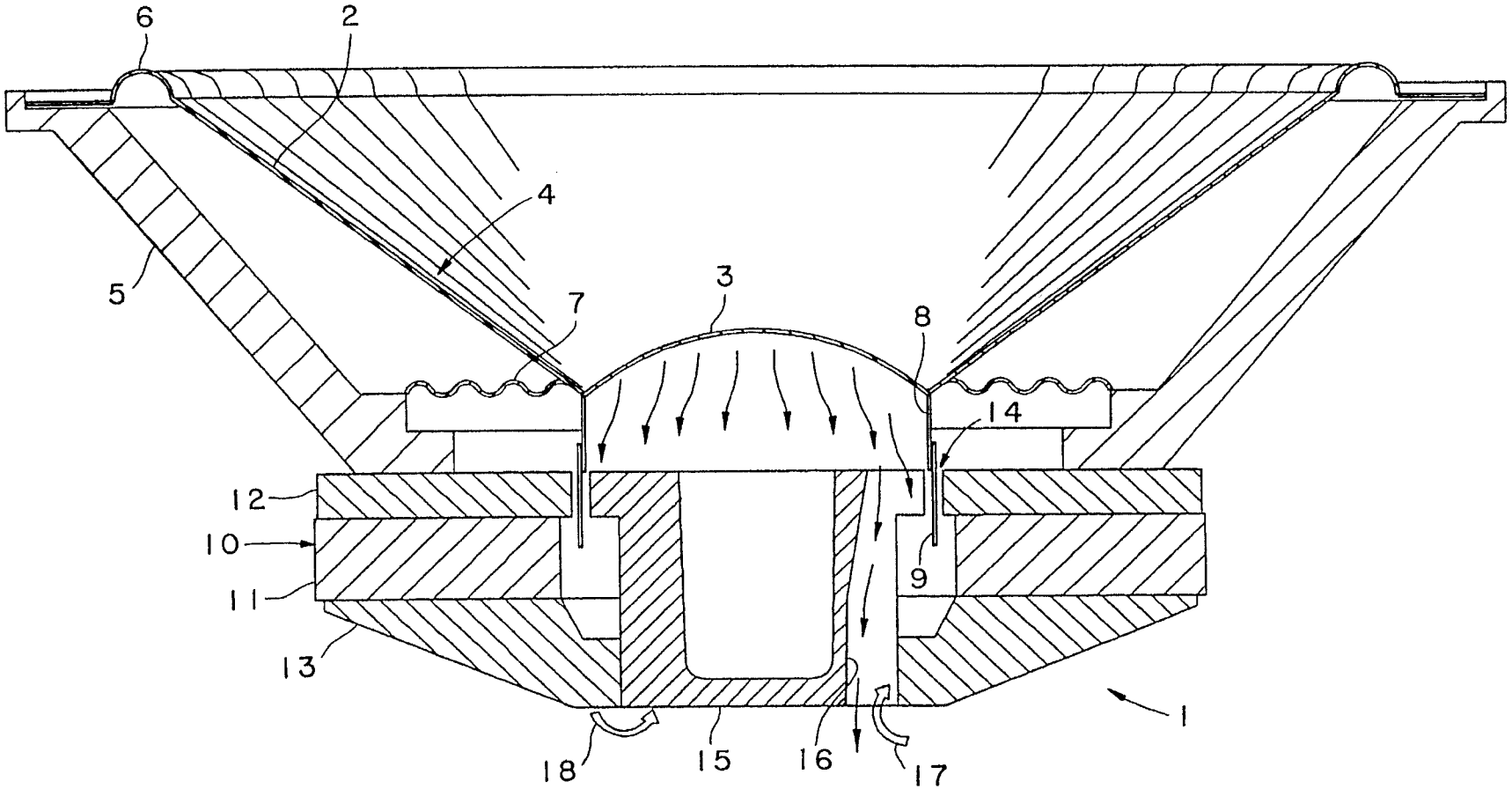
FIG. 1 PRIOR ART
FIG. 1 is a side schematic view of a self-cooled loudspeaker of the prior art.

FIG. 1 shows a conventional electrodynamic loudspeaker 1 comprising a cone 2 fixed by adhesive to a dome 3 so as to form a diaphragm 4 which may be constructed from paper as it is well known. Diaphragm 4 is connected to a stiff support frame 5 by means of flexible annular portion 6. The radial movement of the diaphragm is prevented by a spider 7 connecting the lower part of the diaphragm to frame 5.

A voice coil 9 is attached, through a former 8, to the lower part of diaphragm 4, the voice coil being arranged within a magnetic field of a magnetic structure 10 comprising a permanent magnet 11 located between a top plate 12 and a back plate 13 made from a material capable of carrying magnetic flux. As a result of a signal in the form of an electrical current passing through the voice coil and the magnetic field produced by the permanent magnet, the voice coil is caused to oscillate vertically, that is with reciprocating movement in the vertical sense of the drawing, so that the diaphragm is made to vibrate to produce sound. Voice coil 9 oscillates in a magnetic gap 14 formed between top plate 12 and a pole piece 15 constructed from a material capable of carrying the magnetic flux generated by magnet 10.

During operation, the resistance of the voice coil material produces heat that must be removed by cooling the coil by means of cooling air forced through the coil, for example. In order to remove heat from the coil without the need of an external blower, the pole piece 15 of the conventional loudspeaker of FIG. 1 is provided with a plurality of peripheral and longitudinal passages 16 along which the air, indicated by the arrows, is forced thanks to the oscillating movement of diaphragm 4. As a consequence, the external surface of piece 15 is interrupted and the magnetic flux is not efficiently transferred from plates 12, 13 to pole piece 15. As it is shown by arrow 17, the magnetic flux from plate 13, at the right side of the drawing, is closed over the plate without being transferred to piece 15. If the external surface were continuous as it is at the left side of the piece, the magnetic flux would be transferred as it is shown by arrow 18.

In addition to the above mentioned drawbacks, the heat removal is restricted to the small surface defined by the inner walls of each passage 16, and this surface may be not enough to remove all the generated heat. There is a structural limitation, however, for the number of passages to be formed in the pole piece.

Figure 2:
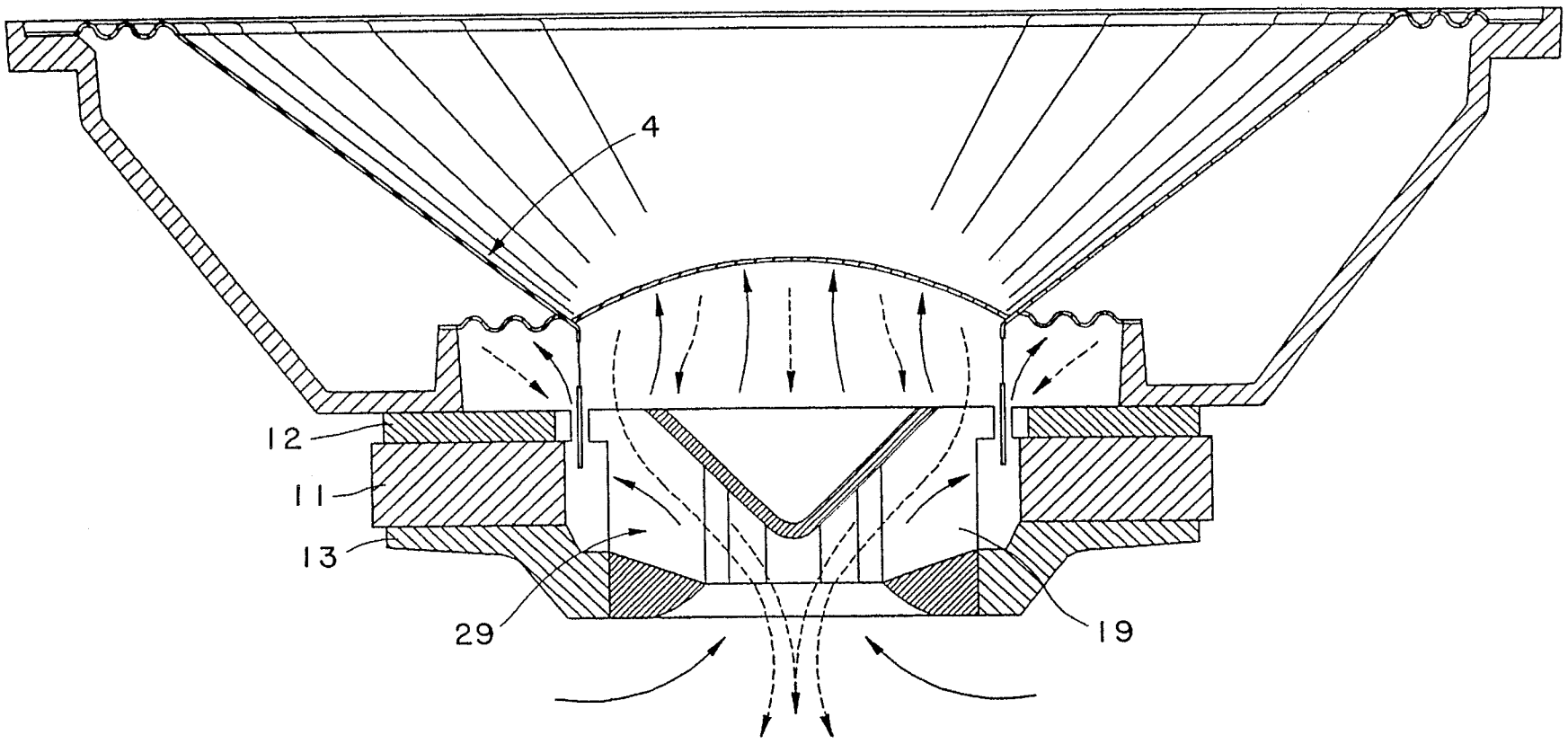
FIG. 2 is a side view, similar to FIG. 1, of a loudspeaker incorporating the features of the invention.
Figure 3:
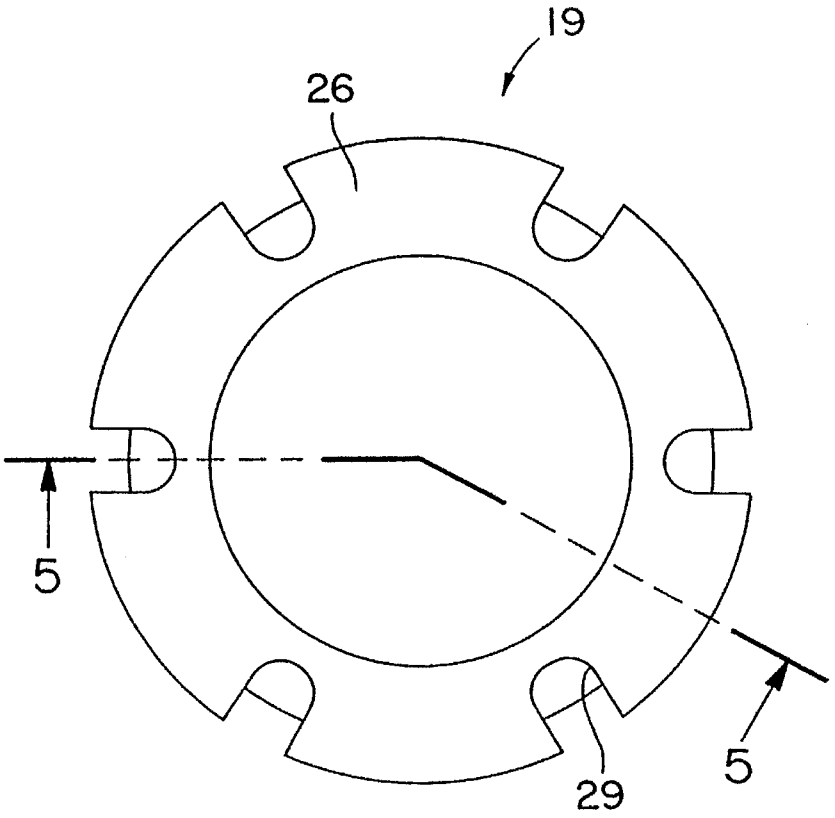
FIG. 3 is a plan view of the pole piece forming the invention.
Figure 5:
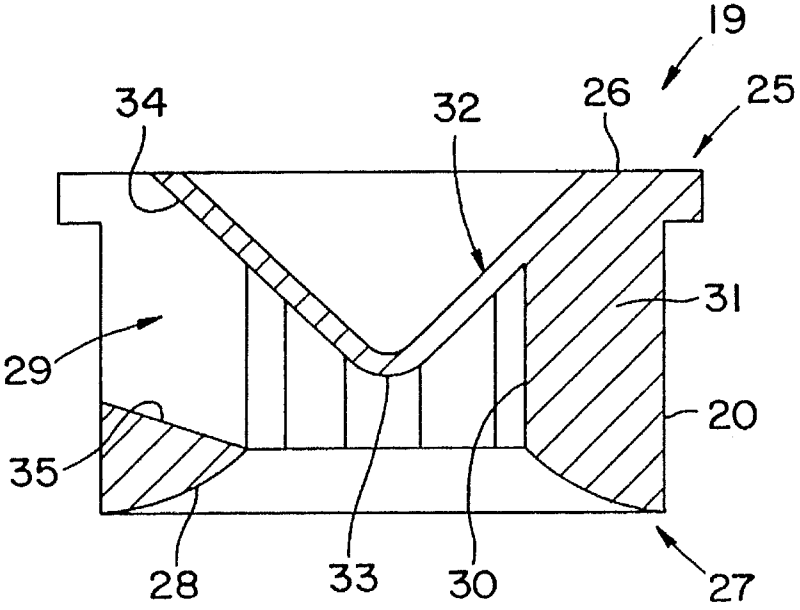
FIG. 5 is a sectional view of the pole piece, taken along lines 5—5 of FIG. 3.
Figure 6:
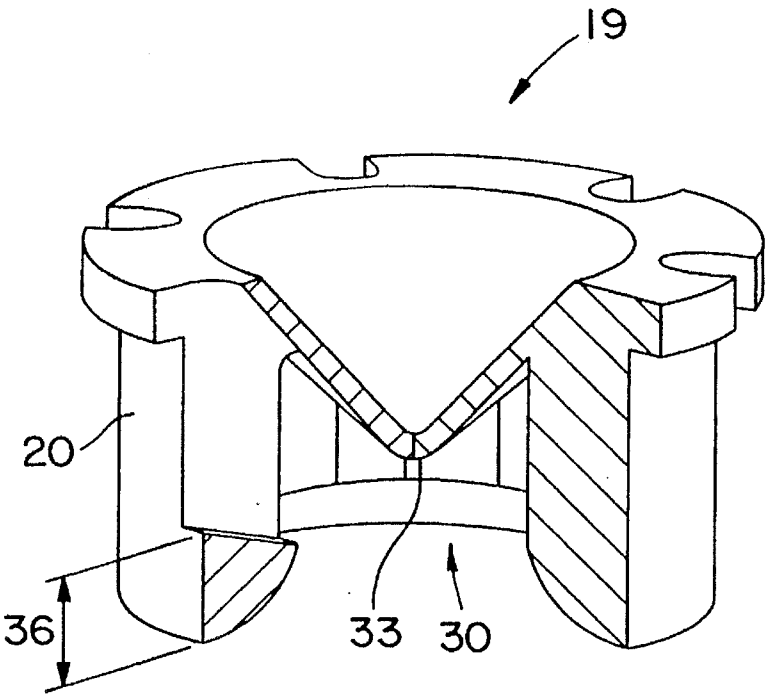
FIG. 6 is a partially sectional perspective view of the pole piece of the invention.
Figure 4:
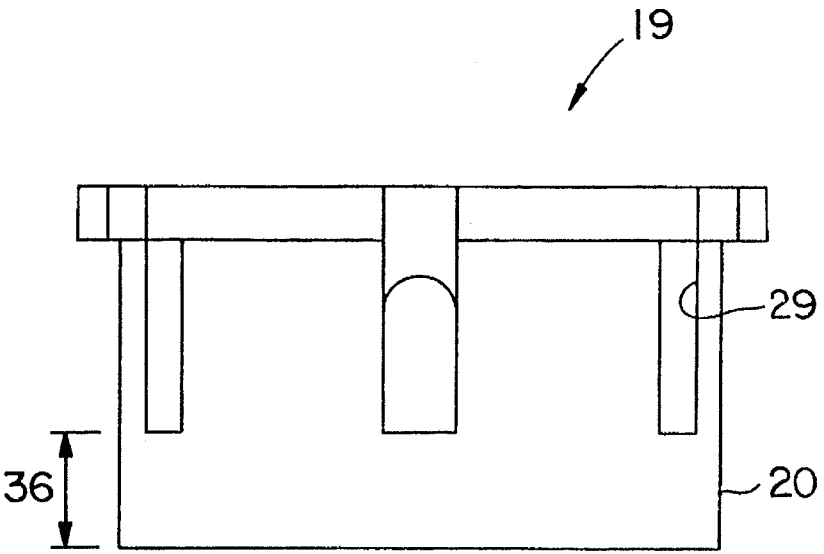
FIG. 4 is a side elevational view of the pole piece of FIG. 3.

In order to overcome the above described drawbacks the invention provides a loudspeaker as shown in FIG. 2 wherein most of the parts thereof may be conventional ones, and they will not be described in detail, with the exception of a pole piece 19 including improved cooling means according to the invention. These conventional parts other than the pole piece, like the diaphragm, cone, frame, magnet and coil will be referred to by the same numeral references used in FIG. 1.

Pole piece 19 according to the invention, completely shown in FIGS. 2–6, comprises a substantially cylindrical piece constructed from a material capable of carrying magnetic flux. The piece is part of a magnetic structure of the loudspeaker, the magnetic structure is formed by magnet 11, top plate 12 and back plate 13 respectively adjacent to opposite sides of the magnet, and pole piece 19, the pole piece has an outer surface defining a periphery around which magnet 11 is arranged. Coil 9 is located so as to encircle as upper and 25 of piece 19, and 25 including an upper face 26. Piece 19 also has a lower end 27 including a lower annular continuous face 28.

Piece 19 includes at least two channels 29 for circulation of cooling air, the channels continuously extending from upper face 26, partially along the periphery of the piece and into a central cavity 30, the cavity being closed at the upper face of the piece and open into the lower face of the piece. Piece 19 defines a cylindrical wall 31, and the upper face forms a cone 32 so that the cavity has a conical closed upper end with the apex 33 of the cone facing the open lower face 28.

The conical closed end of cavity 30 extends into an upper portion of each channel 29 so that each channel has a radially inwardly-downwardly-extending upper wall 34. In addition, channel 29 has a radially inwardly-downwardly-extending lower wall 35 so that channel 29 defines a radially-downwardly inwardly extending passage capable of channeling the cooling air through and out of the pole piece and increasing the thermal exchanging surface of the piece. The air will circulate as illustrated by the arrows depicted in phantom lines and the heat will be removed from not only the surface of the passage walls but also from the surface of cone 32. This arrangement will also provide a better circulation of air and an increased air flow because the sectional areas of each channel can be larger, while the structure thereof is not affected. With larger sectional areas the air flow resistance is reduced and no high air pressure is necessary.

Central cavity 30 has preferably a cross-sectional area greater than the sum of the cross-sectional areas of all channels 29.

It is worthwile to remark that channels 29 do not extend along the entire length of surface 20 of piece 19, that is they do not extend from face 26 to face 28 along surface 20, but they extend through wall 31 without forming continuous interruptions in surface 20. Thus a continuous annular lower portion 36 remains defined and capable of carrying a continuous magnetic flux therethrough. Thus the magnetic flux will continuously be transferred from magnetic structure 10 to piece 19 without interrupted sections.

Finally, lower face 28 may extend radially inwardly and upwardly into cavity 30 to facilitate circulation of air into and out of the cavity.

While preferred embodiments of the present invention have been illustrated and described, it will be obvious to those skilled in the art that various changes and modifications may be made therein without departing from the scope of the invention as defined in the appended claims.

I claim:

1. A self-cooling pole piece for loudspeakers comprising a pole piece constructed from a material capable of carrying magnetic flux, the pole piece forming part of a magnetic structure of the loudspeaker, the magnetic structure comprising the pole piece and a magnet located between a top and a back plates, the pole piece defining a periphery adjacent a voice coil, wherein the periphery of the pole piece includes at least two channels for circulation of cooling air, the channels continuously extending from an upper face of the pole piece, partially along the periphery of the pole piece and into a central cavity of the pole piece, the cavity being closed at the upper face of the pole piece and open into a lower face of the pole piece.

2. The self-cooling pole piece of claim 1, comprising a tubular piece defining a cylindrical wall, the upper face of the pole piece forming a cone so that the cavity has a conical closed upper end with the apex of the cone facing the open lower face of the pole piece so as to guide the cooling air through and out of the pole piece and increase the thermal exchanging surface of the pole piece.

3. The self-cooling pole piece of claim 2, wherein the central cavity has a cross-sectional area greater than the sum of the cross-sectional areas of all the channels.

4. The self-cooling pole piece of claim 2, wherein the lower face of the pole piece is a continuous annular face forming, with the cylindrical wall, a continuous annular lower portion of the pole piece capable of carrying a continuous magnetic flux therethrough.

5. The self-cooling pole piece of claim 2, wherein the conical closed end of the cavity extends into an upper portion of each channel so that each channel has a radially inwardly-downwardly-extending upper wall.

6. The self-cooling piece of claim 5, wherein each channel has a radially inwardly-downwardly-extending lower wall.

7. The self-cooling piece of claim 1, wherein the lower face extends radially inwardly and upwardly into said cavity.

8. A self-cooled electrodynamic loudspeaker comprising a frame, a reciprocating diaphragm connected to a voice coil, and a magnetic structure comprising a pole piece constructed from a material capable of carrying magnetic flux and a magnet arranged located between a top and back plates and around the pole piece, the coil being capable of moving reciprocatingly between said pole piece and magnet under the effect of a magnetic flux created across a magnetic gap formed between the pole piece and the top plate and magnet, wherein the improvement consists of at least two channels adjacent to the voice coil for the passage of air driven by the movement of the diaphragm in response to current passing to the voice coil, each channel continuously extending from an upper face of the pole piece, partially along the periphery of the pole piece and into a central cavity of the pole piece, the cavity being closed at the upper face of the pole piece and open into a lower face of the piece.

9. The loudspeaker of claim 8, wherein the pole piece comprises a tubular piece defining a cylindrical wall, the upper face of the pole piece forming a cone so that the cavity has a conical closed upper end with the apex of the cone facing the open lower face of the pole piece so as to guide the cooling air through and out of the pole piece and increase the thermal exchanging surface of the pole piece.

10. The loudspeaker of claim 9, wherein the central cavity has a cross-sectional area greater than the sum of the cross-sectional areas of all the channels.

11. The self-cooling piece of claim 9, wherein the lower face of the pole piece is a continuous annular face forming, with the cylindrical wall, a continuous annular lower portion of the pole piece capable of carrying a continuous magnetic flux therethrough.

12. The self-cooling piece of claim 9, wherein the conical closed end of the cavity extends into an upper portion of each channel so that each channel has a radially-inwardly-downwardly extending upper wall.

13. The self-cooling piece of claim 12, wherein each channel has a radially inwardly-downwardly extending lower wall.

14. The self-cooling piece of claim 8, wherein the lower face extends radially-inwardly and upwardly into said cavity.

15. A self-cooling pole piece for loudspeakers comprising a pole piece constructed from a material capable of carrying magnetic flux, the piece forming part of a magnetic structure of the loudspeaker, the magnetic structure comprising the pole piece and a magnet located between a top and a back plates, the pole piece defining a periphery adjacent a voice coil, wherein the periphery of the pole piece includes at least two channels for circulation of cooling air, the channels continuously extending from an upper face of the pole piece, radially inwardly and downwardly into a central cavity of the pole piece, the cavity being closed by a conical wall at an upper end of the pole piece and open into a lower end of the pole piece.

* * * * *